United States Patent [19]

Akins

[11] Patent Number: 4,633,135

[45] Date of Patent: Dec. 30, 1986

[54] STARTING AID FOR HIGH PRESSURE SODIUM VAPOR LAMP

[75] Inventor: Robert B. Akins, Warrensville Hts., Ohio

[73] Assignee: General Electric Company, Schenectady, N.Y.

[21] Appl. No.: 220,456

[22] Filed: Dec. 29, 1980

[51] Int. Cl.[4] ..... H01J 17/44

[52] U.S. Cl. ..... 313/594; 313/607; 315/344; 315/349; 315/357

[58] Field of Search ..... 315/46, 47, 344, 349, 315/357; 313/198, 201, 594, 667, 234, 46, 47

[56] References Cited

U.S. PATENT DOCUMENTS

| | | | |
|---|---|---|---|
| 2,156,068 | 4/1939 | Ruttenauer et al. | 313/201 |
| 2,829,295 | 4/1958 | Gast et al. | 313/198 |
| 3,872,340 | 3/1975 | Collins | 313/198 |
| 4,065,370 | 12/1977 | Noble et al. | 313/201 |
| 4,074,163 | 2/1978 | Van der Leeuw | 313/13 |
| 4,146,813 | 3/1979 | van Vliet | 313/185 |

*Primary Examiner*—Harold Dixon

*Attorney, Agent, or Firm*—John P. McMahon; Philip L. Schlamp; Fred Jacob

[57] ABSTRACT

A high pressure sodium vapor lamp comprising an alumina arc tube within an outer glass envelope is provided with a capacitive starting aid in the interenvelope space. The aid comprises a stiff wire which is pressed lengthwise against the side of the arc tube by a bimetal arm swinging in a plane normal to the lamp axis. Preferably the wire has a camber concave towards the arc tube which is flattened out at room temperature. In the event of a reclosure, the camber shortens the hot restart time.

1 Claim, 5 Drawing Figures

STARTING AID FOR HIGH PRESSURE SODIUM VAPOR LAMP

The invention relates to high pressure sodium vapor lamps utilizing alumina ceramic envelopes and is particularly concerned with an external capacitive means to facilitate starting of such lamps.

BACKGROUND OF THE INVENTION

High pressure sodium vapor lamps have found widespread use during the past decade for commercial lighting applications, especially outdoor lighting. Such lamps are described in U.S. Pat. No. 3,248,590—Schmidt, High Pressure Sodium Vapor Lamps. They utilize a slender tubular envelope of light-transmissive refractory oxide material resistant to sodium at high temperatures, suitably high density polycrystalline alumina or synthetic sapphire. The filling comprises sodium along with a rare gas to facilitate starting, and mercury for improved efficiency. The ends of the alumina tube are sealed by suitable closure members affording connection to thermionic electrodes which may comprise a refractory metal structure activated by electronemissive material. The ceramic arc tube is generally supported within an outer vitreous envelope or jacket provided at one end with the usual screw base. The electrodes of the arc tube are connected to the terminals of the base, that is to shell and center contact, and the interenvelope space is usually evacuated in order to conserve heat.

The high pressure sodium vapor lamps in larger sizes manufactured for general lighting applications commonly use xenon as the starting gas. The choice of xenon, the heaviest of the readily available inert gases, provides an advantage in efficiency over the lighter inert gases, for instance as much as 10% or more over neon. However the choice of xenon raises the starting voltage requirement and this is met by including in the ballast or current controller an electronic circuit which serves as a source of short duration high voltage pulses. After the lamp is ignited, the voltage across it is reduced and a sensing circuit responds thereto and disables the starting pulse generator.

The efficiency of a xenon-filled H.P.S. lamp increases with the xenon pressure from 10 torr up to several hundred torr, but the starting voltage requirement also increases. A commonly accepted compromise has been a xenon fill pressure of about 20 torr. The ballast for a 400 watt H.P.S. lamp provides a minimum pulse amplitude of 2250 volts at starting. The efficiency of a H.P.S. lamp intended for such ballast may be increased by increasing the xenon fill pressure to 100 or 200 torr, but the lamp then becomes marginal in its ability to start on the existing ballast. Its starting ability may be improved and the lamp made acceptable by providing a capacitive starting aid located within the outer jacket in proximity to the ceramic arc tube.

In U.S. Pat. No. 3,872,340—Collins, a capacitive starting aid is described which comprises a pair of thermally deformable bimetal arms whose ends embrace the arc tube at room temperature and swing away when heated up under operating conditions. There is also known a high pressure sodium lamp of Japanese manufacture in which a long flexible wire is stretched between a pair of bimetal arms fastened to a supporting frame beyond the ends of the arc tube. At room temperature the wire bears against the ceramic arc tube and is partly wrapped around it. At operating temperature the bimetal arms flex and swing the wire away from the arc tube. This arrangement is relatively costly and requires more than the usual degree of skill and care in its assembly. In addition in the case of a hot restart, there is a delay of as much as 10 minutes to permit the lamp and the bimetals to cool and return the starter wire to its room temperature position.

The object of my invention is to provide an external starting aid for a high pressure sodium vapor lamp which is more effective than the Collins' design and which avoids the problems of the Japanese design.

SUMMARY OF THE INVENTION

A capacitive starting aid embodying my invention comprises a light and self-supporting elongated metal member within the outer envelope of a jacketed discharge lamp. At room temperature, the member is pressed lengthwise against the side of the arc tube by a thermally deformable arm swinging in a plane normal to the arc tube. The swinging end of the arm is centrally attached to the member, that is close to the midpoint of the member, and the opposite end is attached to a frame member supporting the arc tube and electrically connected to one electrode. After the lamp has started and warmed up, heat from the arc tube causes the arm to deflect and swing the member away from the arc tube.

In a preferred arrangement, the member is a stiff wire having a camber or slight arching concave toward the arc tube and the thermally deformable arm supporting it is a bimetal strip. At room temperature when the bimetal presses the wire against the arc tube, the camber is flattened out. In the event of a reclosure, the camber allows the ends of the wire to approach and contact the arc tube earlier in the cooling cycle, thus shortening the hot restart time, that is the delay in restarting following a period of operation.

DETAILED DESCRIPTION

Figure 1:
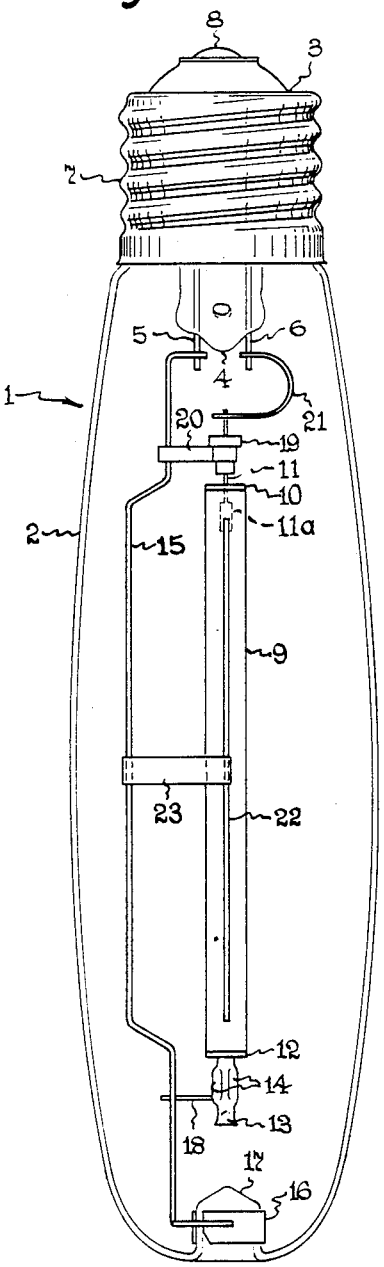
FIG. 1 is a front elevation view of a high pressure sodium vapor discharge lamp embodying the invention in preferred form.

A high pressure sodium vapor lamp 1 embodying the invention and corresponding to a 250 watt size is illustrated in FIG. 1. It comprises a vitreous outer envelope 2 with a standard mogul screw base 3 attached to the stem end which is shown uppermost. A re-entrant stem press 4 has a pair of relatively heavy lead-in conductors 5,6 extending through it whose outer ends are connected to the screw shell 7 and eyelet 8 of the base.

The inner envelope or arc tube 9 centrally located within the outer envelope comprises a length of light-transmitting ceramic tubing, suitably polycrystalline alumina ceramic which is translucent, or single crystal alumina which is clear and transparent. The upper end of the arc tube is closed by an alumina ceramic plug 10 through which extends hermetically a niobium inlead wire 11 which supports the upper electrode 11*a* shown in dotted lines. The lower end closure also comprises a ceramic plug 12 through which extends a thin-walled niobium tube 13 which serves both as inlead and as a reservoir for excess alkali metal and mercury. The shank of the lower electrode projects into tube 13 and is locked in place by crimping the tube about it at 14. The crimping leaves restricted channels which allow passage of the alkali and mercury in vapor form but prevent its movement as a liquid amalgam whereby the lamp may be burned not only base-up as shown but also base-down. The ceramic seals are described in greater detail in U.S. Pat. No. 4,065,691—McVey, Ceramic Lamp Having Electrodes Supported by Crimped Tubular Inlead.

The mounting arrangement for supporting the arc tube within the outer envelope allows for differential thermal expansion. A sturdy support rod 15 extends substantially the length of the outer envelope; it is welded to lead-in conductor 5 at the stem end and braced by spring clamp 16 which engages inverted nipple 17 in the distal or dome end of the outer envelope. The arc tube is supported primarily by conductor 18 which is welded across from tubular inlead 13 to support rod 15. At the upper end, axial inlead wire 11 extends through an insulating bushing 19 which is supported from rod 15 by means of metal strap 20 wrapped tightly around it and spot welded to the support rod. The aperture through the bushing is sized to permit free axial movement of inlead wire 11 without allowing excessive side play. A resilient flexible conductor 21 curved to form an open loop has one end welded to inlead wire 11 above the bushing and the other end welded to lead-in conductor 6. Differential thermal expansion is accommodated by axial movement of inlead 11 through bushing 19 and by the flexing of curved conductor 21.

In the preferred embodiment of my invention illustrated, I provide a capacitive starting aid comprising a straightened hard-tempered wire 22 which at room temperature is pressed lengthwise flat against the side of arc tube 9. The wire is supported at its midpoint by a bimetal strip 23 to one end of which it is spot-welded. The other end of strip 23 is spot-welded to support rod 15 so that the same potential is applied to it as to the lower electrode of the arc tube. The wire has a camber facing toward the arc tube, suitably in an amount less than the diameter of the arc tube as illustrated in FIG. 2. At room temperature when the bimetal presses the wire against the arc tube, the camber is flattened. The wire is shorter than the arc tube and proportioned so that its ends lie in the regions of the electrodes.

Figure 2A:
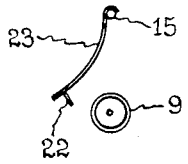
FIGS. 2*a* and 2*b* are fragmentary plan and side elevation views showing the starting aid in the operating condition of the lamp.
Figure 2B:
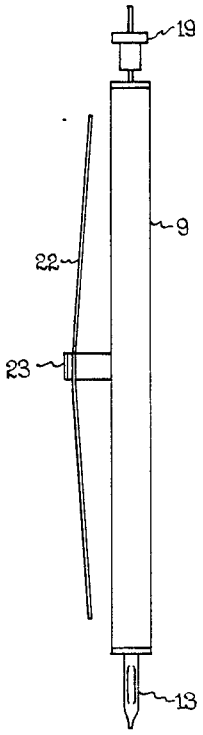
Figure 3:
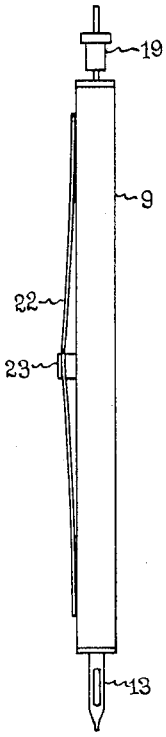
FIG. 3 is a fragmentary view showing the starting aid engaging the arc tube in the cooling cycle.

After the lamp has started and warmed up, the heat from the arc tube warms the bimetal which deflects, swinging wire 22 away from the arc tube as shown in FIGS. 2*a* and 2*b*. In this state the wire regains its natural camber with the result that the midpoint of the wire is swung away from the side of the arc tube more than the tips. I have found this arrangement advantageous for reducing hot restart time. By reason of the camber in the wire, the ends of the wire approach and touch the arc tube close to the electrodes much earlier in the cooling cycle as may be seen in FIG. 3. For instance, in a 250 watt lamp corresponding to that illustrated in the drawing on which I conducted tests, the ends of the wire contacted the arc tube in about one minute after the hot lamp had been turned off, and that was enough for the hot arc tube to restart. On the other hand I found that if the capacitive starting aid took more than two minutes to close, then it became necessary to allow the lamp to cool thoroughly and this would take about 8 minutes.

The bimetal strip 23 is suitably made of commercially available material whereof the low expansion component is a nickel-iron-alloy and the high expansion component is a nickel-chrome-steel alloy. Suitable dimensions for the bimetal strip are 0.005 inch thickness by 0.150 inch width. In the larger sizes of lamps, the bimetal operates at a temperature close to the annealing temperature of the material. A further advantage of the preferred arrangement according to my invention is that the bimetal 23 can swing further away from the arc tube than the ends of wire 22. Thus the bimetal is effectively further removed from the heat source and the possibility of exceeding its annealing temperature is made more remote. At the same time, the movement to which the ends of the wire must be subjected in order to close for a restart is not increased.

Figure 4:
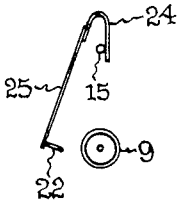
FIG. 4 is a plan view of a variant.

FIG. 4 shows a variant of my invention which may be used with lamps where the danger of exceeding the annealing temperature of the bimetal is greater, for instance higher wattage lamps. As illustrated, a bimetal strip 24 formed to a generally U-shaped cross-section is welded to support rod 15 and arranged to partly encircle it on the side remote from the arc tube. A length 25 of more refractory metal such as stainless steel or molybdenum strip is spot-welded to the swinging end of strip 24, and cambered wire 22 in turn is spot-welded to the end of strip 25. Strip 25 may be made relatively thick and narrow or replaced by a wire if desired in order to intercept less radiation from the arc tube and be cooler.

The capacitive starting aid of my invention has the advantage of simplicity and ease of manufacture resulting from the use of only two parts, a bimetal strip and a wire, and requiring only two welds.

I claim:

1. A high pressure metal vapor lamp comprising:

an outer vitreous envelope enclosing an inner arc tube having thermionic electrodes sealed into its ends and containing a charge of vaporizable metal and inert starting gas; and a capacitive starting aid comprising a light elongated metal member of a stiff wire having a camber or slight arching concave toward the arc tube, said elongated metal member being supported by a thermally deformable arm attached to a frame member within said outer envelope, said frame member being connected to one of its said electrodes;

said arm being arranged to swing in a plane normal to the arc tube and to press said elongated member lengthwise against the arc tube so that said camber of said elongated member is substantially flattened out when the arm presses the wire against the arc tube at room temperture and, said elongated member is swung away from said arc tube when heated by the operation of said lamp.

* * * * *